US005895776A

United States Patent [19]

Aurin et al.

[11] Patent Number: 5,895,776

[45] Date of Patent: Apr. 20, 1999

[54] GRAPHITE-FREE MANDREL BAR LUBRICANT

[75] Inventors: Norbert Aurin, Ockenheim; Thomas Roth, Düsseldorf, both of Germany

[73] Assignee: Chemische Fabrik Budenheim Rudolf A. Oetker, Budenheim, Germany

[21] Appl. No.: 08/931,642

[22] Filed: Sep. 16, 1997

[30] Foreign Application Priority Data

Sep. 17, 1996 [DE] Germany ..... 196 37 837

[51] Int. Cl.[6] ..... C10M 103/06

[52] U.S. Cl. ..... 508/163; 508/155

[58] Field of Search ..... 508/155, 163

[56] References Cited

U.S. PATENT DOCUMENTS

| | | | |
|---|---|---|---|
| 3,368,970 | 2/1968 | Grunze et al. | 508/163 |
| 3,372,113 | 3/1968 | Naeser et al. | 508/163 |
| 3,390,562 | 7/1968 | Rausch et al. | 508/155 |
| 5,437,802 | 8/1995 | Kurahashi et al. | 508/163 |
| 5,710,112 | 1/1998 | Yaegashi et al. | 508/163 |

FOREIGN PATENT DOCUMENTS

| | | |
|---|---|---|
| 0 054 399 | 6/1982 | European Pat. Off. . |

*Primary Examiner*—Jerry D. Johnson
*Attorney, Agent, or Firm*—Michael L. Dunn

[57] ABSTRACT

The invention concerns a lubricant for the hot forming of metals with at least one alkali metal phosphate and possibly additionally at least one phosphate of a divalent metal, which has improved lubricating properties in comparison with known high-temperature lubricants and which at the same time does not attack the workpiece and tool or attacks same to a lesser degree than known lubricants as it contains at least one additives which forms a gas upon being heated.

12 Claims, No Drawings

GRAPHITE-FREE MANDREL BAR LUBRICANT

The invention concerns a lubricant for the hot forming of metals with at least one alkali metal phosphate and possibly in addition at least one phosphate of a divalent metal.

The processing of metals such as for example metal sheets or blooms in rolling or pressing installations requires lubricants which at high processing temperatures guarantee optimum sliding movement of the metal between the processing tools. In the production of shaped metal sheets or seamless tubes in rolling installations, temperatures of 1100 to 1300° C. can occur in such operations. If metals which are hard or which are difficult to work are being processed, the processing tools can suffer from a rapid rate of wear. In that situation lubricants are intended to reduce the frictional resistance between the metal and the tool in order to reduce the amount of tool wear. In that respect the lubricants used must withstand high temperatures. Known lubricants can be subdivided essentially into graphite-bearing and graphite-free lubricants.

Generally organic lubricants such as greases, oils or soaps are used for processing metals at low temperatures. In order to improve their properties at high temperatures, a switch has been made to adding graphite to such lubricants. Graphite is particularly heat-resistant and has particularly good lubricating properties in combination with mineral oils and inorganic salts. A disadvantage of graphite-bearing lubricants is that carburisation phenomena in respect of the metal surface of the workpiece occur as a result of the high carbon content. In that situation defective end products with poor material properties or poor properties in terms of further processing may be the result. That leads to a high level of workpiece wastage. A further problem which is frequently observed with graphite-bearing lubricants is that spot welding effects occur between the workpiece and the tool. In that respect in particular the tools are severely attacked and the surface of the workpiece suffers deterioration.

Other lubricants which can be both graphite-bearing and also graphite-free contain salts or salt mixtures which melt on the hot workpieces and which due to the melt effect form a lubricating separating layer between the workpiece and the tool. Only certain salts are suitable for that purpose however and some have such high melting temperatures that the lubricants are fully operational only when the working temperature is reached. That is particularly disadvantageous for example when starting up the processing machines when the tools or workpieces are still cold. Some lubricants use borax as a salt with a low melting point, in conjunction with mineral oils. It has been found however that with borax-bearing lubricants the tool and the workpiece may stick together so that damage to the tools occurs or the machines come to a halt. In addition borax-bearing lubricants adversely attack the metal surface of the tool or the workpiece.

Further known lubricants use crude common salt, which however in the case of the workpiece results in material being removed therefrom and applied thereto at another location and thus gives rise to the formation of a scoring configuration thereon. Water-soluble lubricants based on alkali metal phosphates and alkali metal borates, which are also used in mixture with various metal oxides such as zinc oxide or iron oxide, also attack the surface of the metal to be processed.

A further-group of high-temperature lubricants includes alkali metal phosphate glasses or silicate glasses with various additives such as boron or aluminium. Those lubricants have good lubricating properties, but they are poorly water-soluble, which makes the removal thereof from the processed workpiece considerably more difficult and requires a high level of technical expenditure.

DE 24 30 249 describes a high-temperature lubricant for the hot working of metals based on a phosphate borate glass with alkali metal, alkaline-earth and heavy metal phosphates and borates, lubrication-enhancing additives such as zinc sulphide, calcium fluoride, sodium fluoride, graphite, sodium chloride and sodium zinc polyphosphate, a stabilisation agent and a binding agent. The lubricant additionally contains an organic propellant on the basis of cellulose, starch, synthetic resin or oil, which breaks down at higher temperatures and produces a gas separation layer between the workpiece and the tool, in addition to the lubricant separation layer. In comparison with the above-mentioned lubricants, the propellant affords a considerably improved lubricating effect. The lubricant described in DE 24 30 249 however suffers from the disadvantages of the above-described graphite-bearing and borax-bearing lubricants. In addition to the graphite added as a lubricant, upon breakdown of the organic propellant a considerable amount of carbon is produced, which causes carburisation of the metal surface of the workpiece. In addition the proportion of water-insoluble salts and oxides makes it difficult for later removing the lubricant from the processed workpiece.

DE 14 44 794 describes an inorganic high-temperature lubricant comprising a mixture of sodium and potassium phosphates which additionally contains one or more divalent metals, in particular magnesium, zinc or manganese. As the lubricant disclosed in DE 14 44 794 does not contain carbon, there is also no carburisation of the processed metal surface, but it has poorer lubricating properties than many other known lubricants.

The object of the present invention is to provide a high-temperature lubricant which has improved lubricating properties over the state of the art and which at the same time does not attack the workpiece and the tool or attacks same to a lesser degree than known lubricants.

That object is attained by a lubricant having at least one alkali metal phosphate which contains at least one additive which forms a gas upon being heated.

Desirably the gas-forming additive is inorganic and preferably contains at least one inorganic carbonate.

A particular advantage of the high-temperature lubricant of the present invention over known graphite-bearing lubricants is that it contains no carbon or only very little carbon. At elevated temperature the additive contained therein spontaneously decomposes and forms in addition to the molten phosphate between the workpiece and the tool a gas separation layer which considerably enhances the lubricating effect. There is therefore also no need as hitherto for graphite to be used as an additional lubricant for enhancing the high-temperature properties of the lubricant. Carburisation phenomena in respect of the metal surface of the workpiece, as are known from graphite-bearing lubricants, do not occur with the lubricant of the present invention. If the gas-forming additive has organic anions such as for example oxalate, the carbon content of the lubricant is nonetheless so low, upon thermal decomposition of the additive, that even then carburisation phenomena do not occur. Most carbonaceous anions, like also the inorganic carbonate which is preferably used, but also some organic anions, form unreactive carbon dioxide upon thermal decomposition as the carbonaceous reaction product, so that carbon in its free form simply does not occur at all.

A further advantage of the lubricant of the present invention is the high temperature range in which the lubricant occurs in a liquid condition. It already begins to melt at 200 to 250° C. and is present as a clear molten material as from 500° C. That already guarantees good lubricating properties at low temperatures as occur for example when starting up the processing machines.

A particularly advantageous property of the lubricant of the present invention is the descaling action thereof. The composition of the lubricant has the property of satisfactorily loosening scale present on the metal surface of the workpiece, thereby removing it and thus furnishing improved end products.

An advantage of the present lubricant which is useful in particular in the processing of workpieces which involve difficult access, such as for example seam-less tubes, is the good water-solubility of the lubricant. After the operation of processing the workpiece the lubricant can be washed off without lubricant residues remaining behind, without involving a high level of technical expenditure.

In a preferred embodiment of the lubricant of the present invention the gas-forming additive contains at least one carbonate of at least one divalent metal, preferably an alkaline earth metal. The use of calcium carbonate as the gas-forming additive is particularly desirable.

In an operation for the mechanical processing of a workpiece calcium carbonate causes the formation of a gas cushion between the tool and the workpiece, whereby the amount of force required for the intended shaping operation is greatly reduced. In addition calcium carbonate is very soft and in the solid condition has good polishing properties. Undecomposed components of calcium carbonate thus have additional separation properties which further improve the separation capability of the molten phosphate and further reduce the frictional resistance between the workpiece and the tool. The surface of the workpiece is smoothed by the polishing properties of the solid calcium carbonate, without the workpiece surface being ground or lapped with emery, and without scoring and scratching occurring in that situation. That is particularly advantageous at the beginning of the procedure for processing the workpiece as thus scale particles are loosened and mechanically removed.

Desirably the gas-forming additive is contained in the lubricant of the present invention in the form of powder, preferably with a grain size of 2 to 50 μm, particularly preferably with a grain size of 2 to 30 μm. This specific selection of the grain size has proven to be highly desirable as it has a particularly advantageous influence on the thermal decomposition properties and the polishing action of the gas-forming additive.

It is particularly desirable if the gas-forming additive is contained in the lubricant in an amount of 5 to 50% by weight, preferably 20 to 40% by weight, particularly preferably 25 to 30% by weight. In that respect the amount of gas-forming additive substantially depends on the processing procedure, the processing temperature and the material to be processed.

In a further preferred embodiment of the invention the lubricant contains a phosphate mixture corresponding to 55 to 69% by weight $P_2O_5$, 14 to 45% by weight $Na_2O$, 5 to 27% by weight $K_2O$, and 0 to 10% by weight MO, wherein M is a divalent metal, preferably zinc, manganese and/or magnesium. It is particularly suitable if the proportion of MO corresponds to 0 to 5% by weight. Such a phosphate mixture has all desired properties such as water-solubility and a low melting point of 200 to 250° C. if the phosphates are used in the form of monophosphates. Up to about 400° C. the phosphates are primarily present in the molten material in the form of diphosphates, besides mono- and higher-condensed phosphates. At about 500° C. a clear molten material is formed, with excellent lubricating properties. For higher temperatures it has been found desirable to replace small amounts of the sodium and/or potassium by equivalent amounts of one or more divalent metals, in particular magnesium, zinc or manganese. The addition of divalent metals increases the adhesion of the lubricant to the metal surfaces to be processed. Desirably the divalent metals are also added to the mixture in the form of phosphates. Advantageously the mixture may also contain trivalent metals but because of their difficult solubility they should be present only in small amounts, that is to say below 1%, preferably below 0.2%.

A further preferred embodiment of the lubricant of the present invention additionally contains 1 to 10% by weight of solid lubricating substances, preferably 1 to 5% by weight with respect to the weight of the gas-forming additive. Preferably zinc pyrophosphate, iron pyrophosphate and/or boronitrite are used as the solid lubricating substances.

The use of the lubricant of the present invention is desirably effected by applying the mixture in powder form to the tool or the workpiece. In order to provide for particularly uniform distribution of the lubricant the powder can also be suspended in water and the surfaces to be lubricated can be coated or painted or sprayed therewith. It is however also possible for the workpieces to be processed to be heated in a molten bath of the lubricant and then processed. Other forms of use such as for example powder pressings or lubricating crayons are possible and may be desirable depending on the respective use involved. It is also particularly advantageous for the workpiece or the tool to be dipped in the hot condition into the lubricant mixture or rolled around therein, thus to produce a coating thereon.

The lubricant of the present invention has proven to be particularly suitable in terms of use in planetary rolling technologies, piercing mills (system Mannesmann-Demag) or in other longitudinal rolling procedures, for example for the production of seam-less tubes. In the production of such tubes for example a pierced billet or ingot is pushed together with a mandrel bar into a planetary rolling mechanism. While the bloom or ingot is reduced in diameter it is moved axially in the rolling direction. In that process, the use of the lubricant of the present invention provides that the amount of force required for changing the shape of the metal workpiece was considerably reduced and the subsequent Operation of cleaning the resulting product was facilitated as the product only had to be flushed out with water. Application of the lubricant according to the invention was effected prior to insertion of the mandrel bar by blowing the lubricant in powder form into the pierced billet or ingot by means of a suitable piece of equipment or at the piercing mill by spraying an aqueous solution of the lubricant between the workpiece and the guide shoe during the rolling process. A marked acceleration in the rolling procedure was achieved by using the lubricant according to the invention, in comparison with conventional lubricants. A considerable reduction in the carburisation of the material was achieved, in particular at the inside surfaces of the rolled tubes, in comparison with graphite-bearing or other carbonaceous lubricants. That was particularly apparent when the tubes were to be further shaped as the embrittlement effect of the material surface, caused by the carburisation action, resulted in cracking and roughening of the surface, upon further shaping operations, and rendered such workpieces useless.

Further advantages, features and possible uses of the present invention will be clearly apparent from the following description of preferred embodiments.

EXAMPLE 1

High-temperature lubricants were produced from a) 50 parts of calcium carbonate and 50 parts of a phosphate mixture, b) 25 parts of calcium carbonate and 75 parts of a phosphate mixture, and c) 5 parts of calcium carbonate and 95 parts of a phosphate mixture, wherein the phosphate mixture contains:

60% by weight of $P_2O_5$,

20% by weight of $Na_2O$,

11% by weight of $K_2O$,

3% by weight of ZnO,

3% by weight of MnO and

3% by weight of MgO.

These mixtures according to the invention were used in the production of seamless tubes in a planetary mill with three tapered rollers in a greatly convergent arrangement. Both the mandrel bar used for production of the tubes and also the hot billet or ingot were treated with the lubricants according to the invention before the mandrel bar was threaded into the pierced billet or ingot.

The same process was implemented with a known graphite-bearing high-temperature lubricant, for comparison purposes.

Composition of the comparative lubricant:

85 parts of graphite 10 parts of vinyl acetate maleic acid butylester (Mowilith type, Hoechst)

5 parts of hydroxyethylcellulose (Tylose, Hoechst),

The comparative lubricant was used in the form of an aqueous suspension of the above-indicated composition in a concentration of 25 to 30% by weight.

Subsequently the rolled tubes were subjected to further processing to constitute tube bends and the mechanical properties of the processed materials were compared. When the graphite-bearing lubricant was used, the material surface suffered from embrittlement caused by carburisation due to the high graphite content, and that embrittleness effect resulted in cracking and roughening on the material in the working operation and in a mechanical post-treatment such as drawing and cold pilger process. The workpiece had to be discarded.

When using the lubricants according to the invention, no carburisation effects occurred and neither cracks nor embrittlement nor roughening were to be found.

In addition the lubricants according to the invention are distinguished in that when the apertured blooms or ingots were shaped to give seam-less tubes, a lower amount of force had to be applied by the tool, than with the graphite-bearing lubricant.

EXAMPLE 2

A high-temperature lubricant was produced from 10 parts of calcium carbonate 85 parts of a phosphate mixture, corresponding to that of Example 1, and 5 parts of hydroxyethylcellulose.

The hydroxyethylcellulose serves as a thickener on an organic basis. It advantageously delays sedimentation of the calcium carbonate in the aqueous suspension. Instead of hydroxycellulose, other alkyl celluloses, alginates, polysaccharides or mixtures thereof are also suitable.

In use the described mixture distinguished itself in comparison with the lubricants of Example 1 by a higher level of viscosity and thus a lower flow capability. That caused particularly good adhesion to the surfaces to be processed and a lower degree of drainage of molten lubricant out of the intermediate spaces between the workpiece and the tool.

We claim:

1. A lubricant for the hot forming of metals comprising a phosphate mixture corresponding to:

55 to 69 wt. % of $P_2O_5$, 14 to 35 wt. % of $Na_2O$, 5 to 27 wt. % of $K_2O$, 0 to 10 wt. % of MO, and at least one carbonate of a divalent metal as a gas-forming additive; wherein, M is a divalent metal selected from the group consisting of zinc, manganese, and magnesium.

2. A lubricant according to claim 1 wherein it contains calcium carbonate as the gas-forming additive.

3. A lubricant according to claim 2 wherein the gas-forming additive is in the form of a powder, having a grain size of 2 to 50 μm.

4. A lubricant according to claim 3 wherein it contains the gas-forming additive in an amount of 5 to 50% by weight.

5. A lubricant according to claim 1 wherein the gas-forming additive is in the form of a powder, having a grain size of 2 to 50 μm.

6. A lubricant according to claim 5 wherein it contains the gas-forming additive in an amount of 5 to 50% by weight.

7. A lubricant according to claim 1 wherein it contains the gas-forming additive in an amount of 5 to 50% by weight.

8. A lubricant according to claim 1 wherein the amount of MO is from 0 to 5% by weight.

9. A lubricant according to claim 1 wherein in addition 1 to 10% by weight of solid lubricating substances, with respect to the weight of the gas-forming additive, are present.

10. A lubricant according to claim 9 wherein the solid lubricating substances are selected from the group consisting of zinc pyrophosphate, iron pyrophosphate and boronitrite.

11. Use of a lubricant according to claim 1 for the hot forming of metal in a rolling mechanism.

12. Use of a lubricant according to claim 1 for the lubrication of mandrel bars, blooms or ingots.

* * * * *